US007413030B2

(12) United States Patent
Chen et al.

(10) Patent No.: US 7,413,030 B2
(45) Date of Patent: Aug. 19, 2008

(54) PNEUMATIC HAMMER DRILL HAVING VIBRATION DAMPING END CAP

(75) Inventors: Chun-Hao Chen, Taichung Hsien (TW); Yueh-Pei Liu, Taichung Hsien (TW)

(73) Assignee: Shun Tai Precision Co., Ltd., Taichung Hsien (TW)

( * ) Notice: Subject to any disclaimer, the term of this patent is extended or adjusted under 35 U.S.C. 154(b) by 139 days.

(21) Appl. No.: 11/436,587

(22) Filed: May 19, 2006

(65) Prior Publication Data

US 2007/0227753 A1 Oct. 4, 2007

(51) Int. Cl.
*B25D 17/24* (2006.01)

(52) U.S. Cl. ..... 173/211; 173/169; 173/162.1; 173/162.2

(58) Field of Classification Search ..... 173/211, 173/169, 162.1, 162.2; 464/52; 403/225; 16/431

See application file for complete search history.

(56) References Cited

U.S. PATENT DOCUMENTS 3,788,404 A * 1/1974 Koudelka et al. ..... 173/211
3,920,086 A * 11/1975 Goppen et al. ..... 173/206
4,071,094 A * 1/1978 Kilin et al. ..... 173/211
4,388,972 A * 6/1983 Gidlund ..... 173/162.1
4,648,468 A * 3/1987 Honsa ..... 173/210
4,711,308 A * 12/1987 Blaas et al. ..... 173/162.2
4,723,610 A * 2/1988 Dummermuth et al. ..... 173/1
4,771,833 A * 9/1988 Honsa ..... 173/162.2
4,776,408 A * 10/1988 Elkin et al. ..... 173/211
5,054,562 A * 10/1991 Honsa et al. ..... 173/210
5,697,456 A * 12/1997 Radle et al. ..... 173/162.2
6,161,628 A * 12/2000 Liu ..... 173/168
6,308,378 B1 * 10/2001 Mooty et al. ..... 16/430

OTHER PUBLICATIONS

U.S. Appl. No. 11/522,325, filed Oct. 24, 2006.
U.S. Appl. No. 11/430,956, filed May 10, 2006.

* cited by examiner

*Primary Examiner*—Brian Nash
(74) *Attorney, Agent, or Firm*—Fitzpatrick, Cella, Harper & Scinto

(57) ABSTRACT

A pneumatic hammer drill includes a handle body, a pneumatic cylinder, a piston, a tool, and a damping member. The handle body has an upper part that defines a front cavity and that has a rear end. The pneumatic cylinder has a cylinder rear end fitted in the front cavity, a front tool-connecting end, and a pressure chamber. The piston is disposed slidably in the pressure chamber. The tool is inserted into the pressure chamber through the front tool-connecting end. The damping member is made of a vibration-damping material, and is attached to the rear end of the handle body.

3 Claims, 3 Drawing Sheets

PNEUMATIC HAMMER DRILL HAVING VIBRATION DAMPING END CAP

CROSS-REFERENCE TO RELATED APPLICATION

This application claims priority of Taiwanese Application No. 095205459, filed on Mar. 31, 2006.

BACKGROUND OF THE INVENTION

1. Field of the Invention

The invention relates to a pneumatic hand tool, more particularly to a pneumatic hammer drill.

2. Description of the Related Art

Referring to FIG. 1, a conventional pneumatic hammer drill includes a handle body 1, a pneumatic cylinder 2, an air valve 202, and a tool 4. The handle body 1 has an upper portion 102 defining a cavity 101, and a lower grip portion 103 provided with an air inlet (not shown). The pneumatic cylinder 2 is fitted partially into the cavity 101, and includes a front tool-connecting end 201, a pressure chamber 203, a spring element 204 fitted around the front tool-connecting end 201, a piston 3 inserted slidably into the pressure chamber 203, and an air passage 205 in fluid communication with the pressure chamber 203 and the air valve 202. Highly compressed air is introduced into the air passage 205 via the air inlet in the handle body 1. The air valve 202 is disposed in the cavity 101 adjacent to the pneumatic cylinder 2. The tool 4 is inserted fittingly into the pressure chamber 203 through the front tool-connecting end 201.

In use, an operator holds the lower grip portion 103 of the handle body 1 with one hand, aims the tool 4 on a workpiece (not shown), and presses a switch (not shown). The compressed air flows through the air passage 205 via the air inlet in the handle body 1, and enters a rear side of the pressure chamber 203 so as to push forwardly the piston 3, which in turn, strikes a rear end of the tool 4 so that the tool 4 produces a hammering force on the workpiece. Meanwhile, the other hand of the operator presses a rear end of the upper portion 102 of the handle body 1 so as to maintain contact between the tool 4 and the workpiece.

Although the aforementioned conventional pneumatic hammer drill can achieve its intended purpose, since the upper portion 102 of the handle body 1 is not provided with a damping element at a rear end thereof, during hammering, an impact force between the tool 4 and the workpiece is transmitted to the operator's hands. Long-term exposure to such continuous hammering can lead to injuries of the operator's hands and wrists.

SUMMARY OF THE INVENTION

Therefore, the object of the present invention is to provide a pneumatic hammer drill which has a damping member that can dampen vibration so as to minimize the chance of injuries to the hands and wrists of an operator.

According to this invention, a pneumatic hammer drill comprises a handle body, a pneumatic cylinder, a piston, a tool, and a damping member. The handle body has an upper part that defines a front cavity and that has a rear end. The pneumatic cylinder has a cylinder rear end fitted in the front cavity, a front tool-connecting end, and a pressure chamber. The piston is disposed slidably in the pressure chamber. The tool is inserted into the pressure chamber through the front tool-connecting end. The damping member is made of a vibration-damping material, and is attached to the rear end of the handle body.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
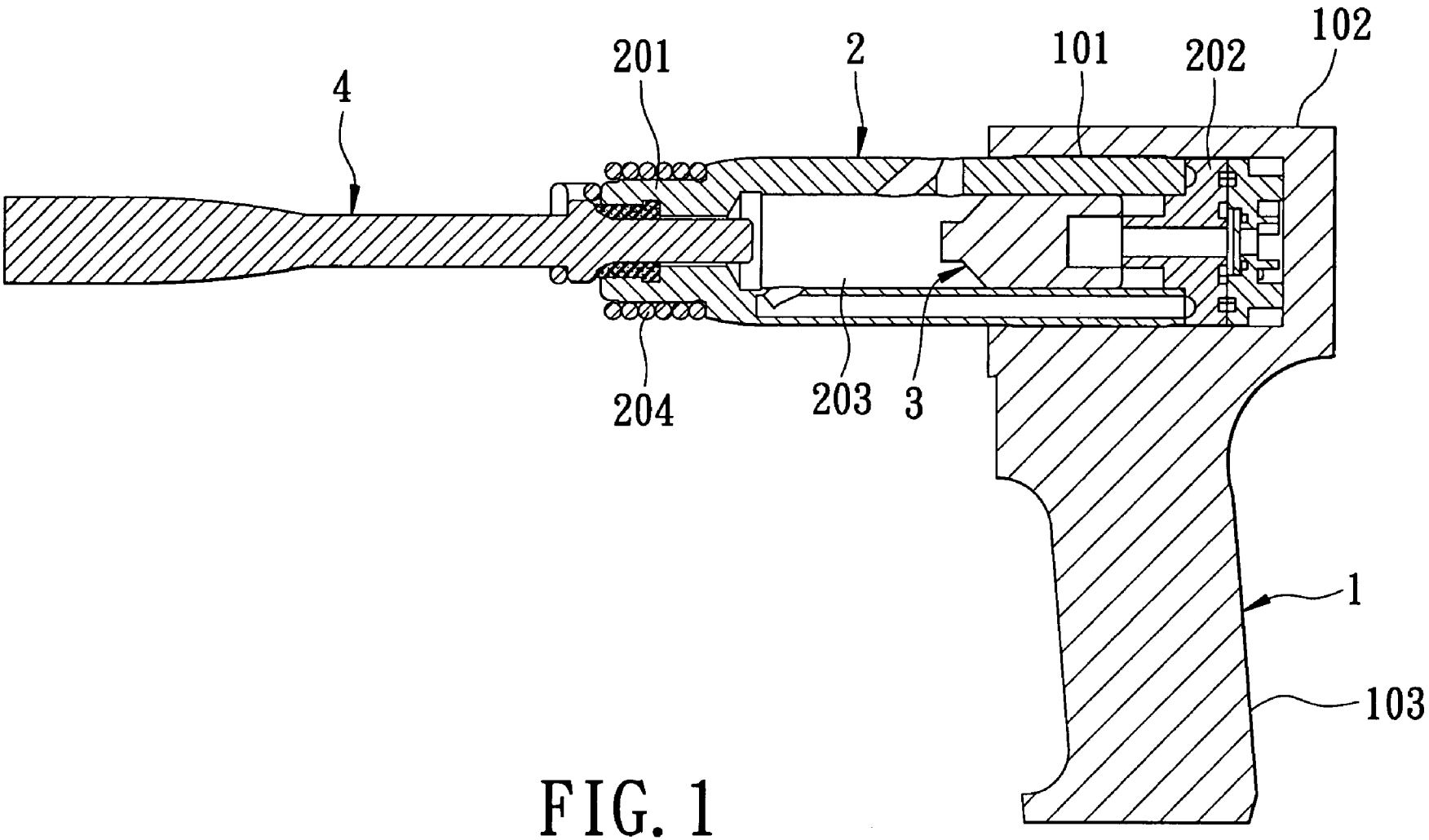
FIG. 1 PRIOR ART
FIG. 1 is a sectional view of a conventional pneumatic hammer drill.
Figure 2:
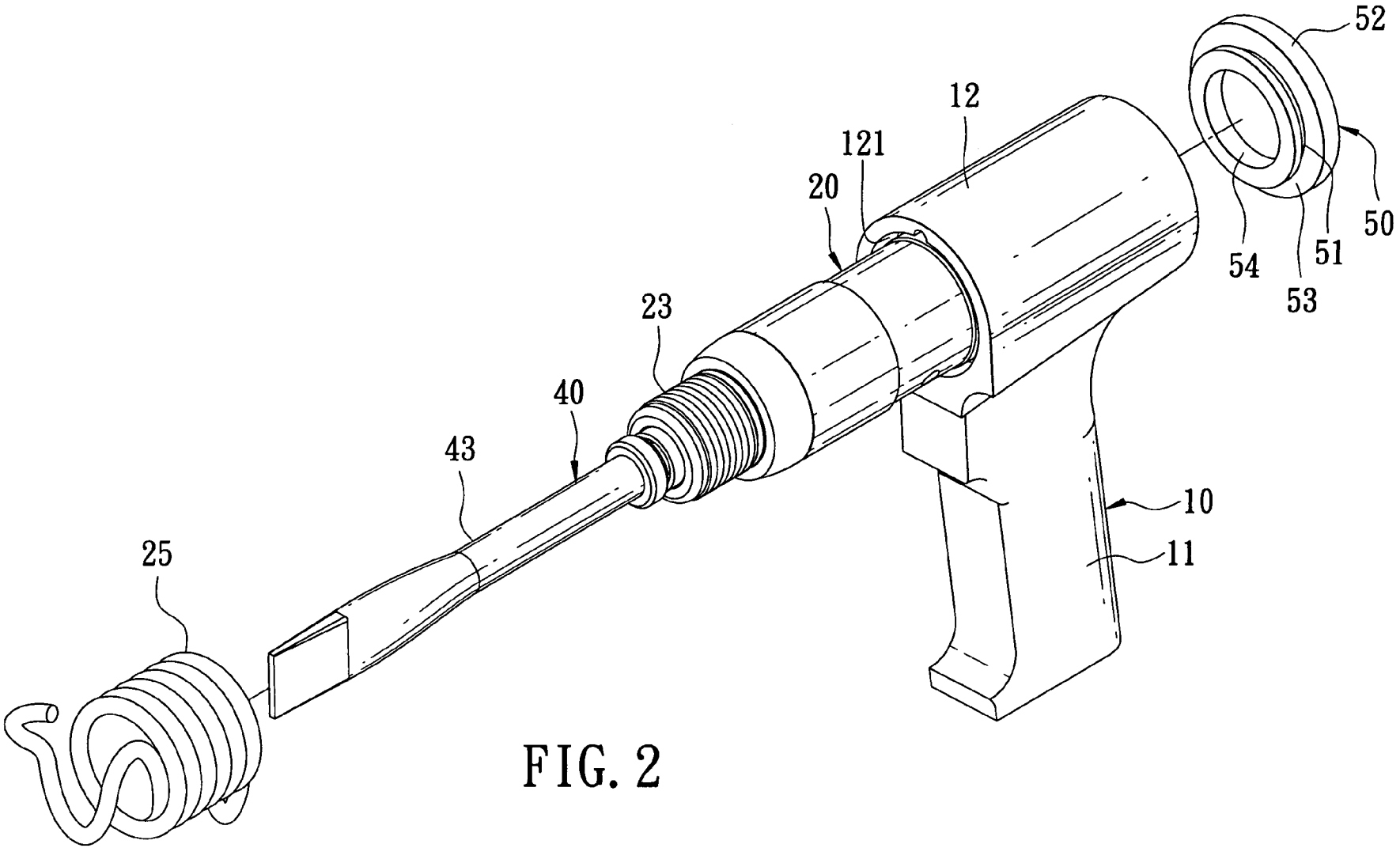
FIG. 2 is a partly exploded perspective view of the preferred embodiment of a pneumatic hammer drill according to the present invention.
Figure 3:
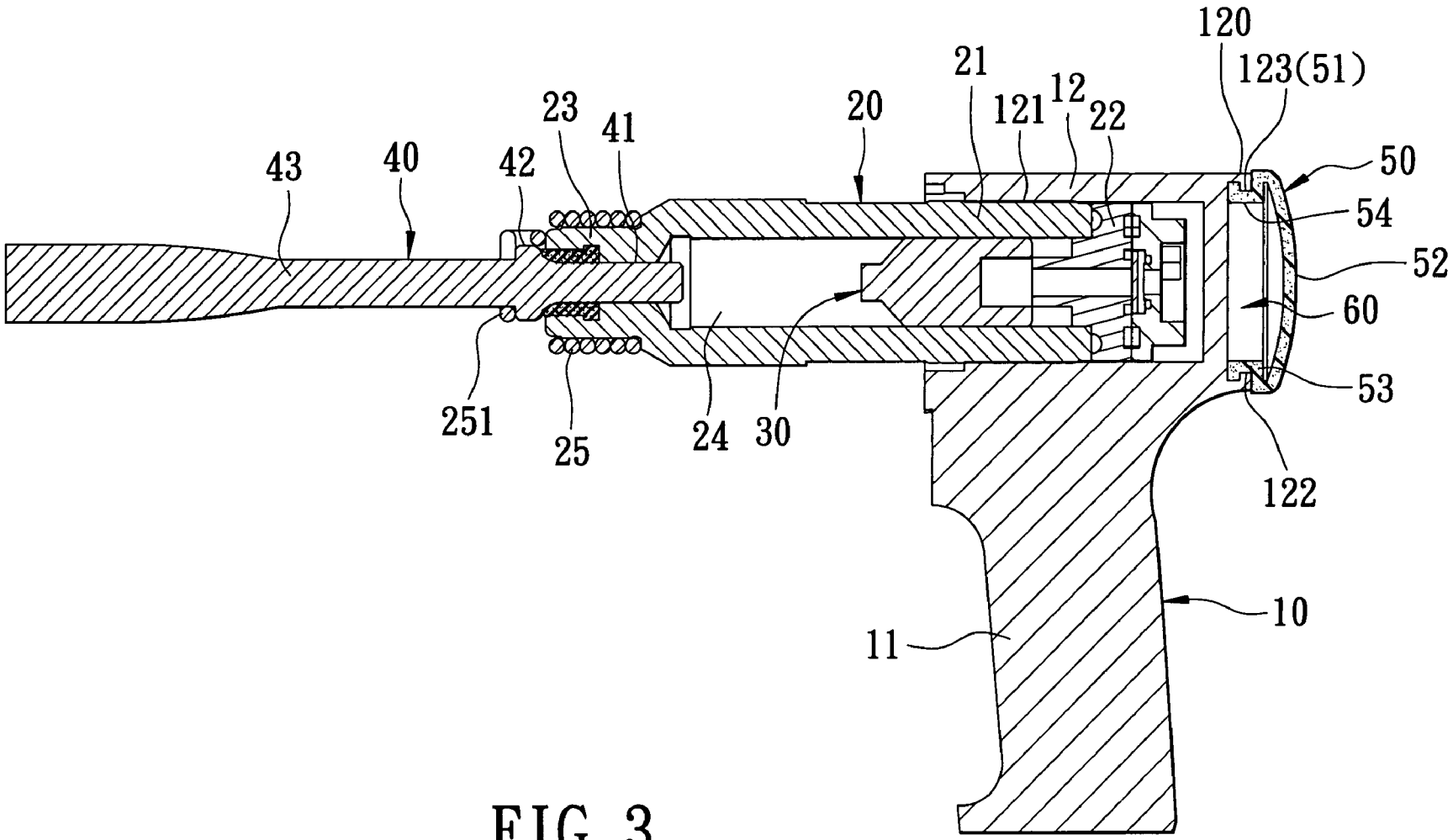
FIG. 3 is a sectional view of the preferred embodiment in an assembled state.

Referring to FIGS. 2 and 3, the preferred embodiment of a pneumatic hammer drill according to the present invention is shown to comprise a handle body 10, a pneumatic cylinder 20, a piston 30, a tool 40, and a damping member 50.

The handle body 10 has an upper part 12, and a lower grip part 11 provided with an air inlet (not shown). The upper part 12 defines a front cavity 121, and has a rear end with an opening 122 defined by a tubular wall 120. The tubular wall 120 has an inwardly extending annular flange 123. Compressed air can be introduced into the handle body 10 via the air inlet.

The pneumatic cylinder 20 has a cylinder rear end 21 fitted in the front cavity 121 of the upper part 12 of the handle body 10, a front tool-connecting end 23 extending outwardly of the front cavity 121, a spring element 25 fitted around the front tool-connecting end 23, and a pressure chamber 24. The spring element 25 has a spring end 251 extending outwardly and curvedly from the front tool-connecting end 23.

An air valve 22 is fitted in the front cavity 121 of the upper part 12 of the handle body 10 rearwardly of the pneumatic cylinder 20.

The piston 30 is disposed slidably in the pressure chamber 24 of the pneumatic cylinder 20.

The tool 40 is inserted into the pressure chamber 24 through the front tool-connecting end 23, and has a rear shank portion 41 extending into the pressure chamber 24 through the front tool-connecting end 23 to allow the piston 30 to strike the rear shank portion 41 of the tool 40, and a front chisel portion 43 extending forwardly from the rear shank portion 41 and adapted to strike a workpiece. An annular protrusion 42 is formed proximate to the rear shank portion 41, and abuts against the front tool-connecting end 23. The tool 40 cannot be released from the pneumatic cylinder 20 as the annular protrusion 42 thereof is engaged with and is connected to the spring end 251 of the spring element 25.

The damping member 50 is attached to the tubular wall 120 of the upper part 12 of the handle body 10, and is made of a vibration-damping material. In this embodiment, the damping member 50 is made of rubber, and is configured as a cap covering the opening 122 of the handle body 10. The damping member 50 has a substantially dome-shaped capping portion 52 at a rear end thereof, a cap rim 53 around the capping portion 52, an annular neck 54 projecting forwardly from the cap rim 53 and inserted into the opening 122 of the tubular wall 120, and an annular groove 51 formed in the annular neck 54. The inwardly extending annular flange 123 of the tubular wall 120 is engaged to the annular groove 51 of the damping member 50. The damping member 50 and the tubular wall 120 cooperate with each other to define therebetween a damping air space 60. The dome-shape of the capping portion 52 provides an increased volume to the damping air space 60 to thereby allow the damping air space 60 to hold more air.

In use, an operator holds with one hand the lower grip portion 11 of the handle body 10, aims the tool 40 on the workpiece, and presses a switch (not shown) so as to supply the compressed air into the handle body 10 via the air inlet. The air flows through the air valve 22, and enters a rear side of the pressure chamber 24 so as to push the piston 30 forwardly. The piston 30, in turn, strikes reciprocatingly a rear end of the tool 40 so that the tool 40 produces a hammering force on the workpiece. Meanwhile, the other hand of the operator presses the damping member 50 on the rear end of the upper part 12 of the handle body 10 so that the tool 40 can maintain contact with and can continue hammering the workpiece.

Because the air contained in the damping air space 60 in the rear end of the handle body 10 functions as a damping medium, part of the vibration generated upon hammering can be absorbed by the damping air space 60, while most of the remaining part of the vibration can be absorbed by the material of the damping member 50 itself. Since the vibration generated upon hammering can be largely reduced, injuries to the operator's hands and wrists can also be reduced to a minimum.

While the damping member 50 is in the form of a cap in this embodiment, it is contemplated that the damping member 50 could be a solid piece attached to the rear end of the upper part 12 of the handle body 10.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A pneumatic hammer drill, comprising:

a handle body having an upper part that defines a front cavity and that has a rear end, said rear end having a tubular wall defining a damping air space (shown at 60) and an opening communicated with said damping air space;

a pneumatic cylinder having a cylinder rear end fitted in said front cavity, a front tool-connecting end, and a pressure chamber;

a piston disposed slidably in said pressure chamber;

a tool inserted into said pressure chamber through said front tool-connecting end; and a damping member configured as a cap covering said opening and sealing said damping air space, said cap being made of rubber that is compressible and deformable to absorb vibration forces, wherein no venting hole is communicated with said damping air space.

2. The pneumatic hammer drill of claim 1, wherein said cap has a cap rim, an annular neck projecting from said cap rim and inserted into said tubular wall, and an annular groove formed in said annular neck, said tubular wall having an inwardly extending annular flange engaged to said annular groove.

3. The pneumatic hammer drill of claim 1, wherein said cap has a substantially domed-shape capping portion covering said opening.

* * * * *